US005131914A

United States Patent [19]

Kelley

[11] Patent Number: 5,131,914

[45] Date of Patent: Jul. 21, 1992

[54] PROCESS FOR PREPARING MULTI-COLORED DYED POLYAMIDE SUBSTRATES INCLUDING THE APPLICATION OF A REACTIVE VINYL SULFONE DYE AND A RESIST AGENT

[75] Inventor: Larry C. Kelley, Dalton, Ga.

[73] Assignee: Hoechst Celanese Corporation, Somerville, N.J.

[21] Appl. No.: 626,807

[22] Filed: Dec. 13, 1990

[51] Int. Cl.[5] ..... D06P 5/12

[52] U.S. Cl. ..... 8/449; 8/446; 8/924; 8/929

[58] Field of Search ..... 8/449, 446, 924, 929

[56] References Cited

U.S. PATENT DOCUMENTS

| | | | |
|---|---|---|---|
| 3,118,723 | 1/1964 | Harding | 8/14 |
| 3,663,157 | 5/1972 | Gilgien | 8/65 |
| 3,790,344 | 2/1974 | Frickenhaus | 8/165 |
| 4,218,217 | 8/1980 | Redd, Jr. | 8/448 |
| 4,278,433 | 7/1981 | Blum et al. | 8/449 |
| 4,336,190 | 6/1982 | Schwaiger et al. | 8/681 |
| 4,441,883 | 4/1984 | Vavala | 8/457 |
| 4,577,015 | 3/1986 | Jäger et al. | 8/657 |
| 4,592,940 | 6/1986 | Blyth et al. | 252/8.7 |
| 4,680,033 | 7/1987 | Dürl et al. | 8/449 |
| 4,822,373 | 4/1989 | Olson et al. | 8/115.6 |

*Primary Examiner*—A. Lionel Clingman

*Assistant Examiner*—Bradley A. Swope

[57] ABSTRACT

This is a method for producing multi-colored polyamide dyeings which is particularly useful in the multi-colored dyeing of polyamide carpets. In this method, a three-component dyeing system is employed which comprises a fiber reactive dye, an anionic resist and an acid-type dye. The anionic resist is a water-soluble, fiber substantative compound which displaces and/or prevents the fiber-reactive dye form fixing in that portion of the carpet which has been treated with the resist. The anionic resist, however, will not displace the acid-type dye component nor does it prevent fixation of the acid-type dye component. The invention may be practiced by first printing the polyamide substrate in a predetermined pattern with a printing paste containing the acid-type dye and the anionic resist. The substrate is then flooded or blotch printed with the fiber reactive dye and steamed to fix the dyes. Alternatively, the substrate may be first flooded or blotch printed with the fiber reactive dye. The acid-type dye and anionic resist are then printed on top of the fiber reactive dye. The anionic resist displaces the fiber-reactive dye and the dyes are fixed by steaming. The method produce fine distinct color patterns with essentially no blurring or mixing of the colors between the printed and unprinted portions of the substrate.

18 Claims, No Drawings

PROCESS FOR PREPARING MULTI-COLORED DYED POLYAMIDE SUBSTRATES INCLUDING THE APPLICATION OF A REACTIVE VINYL SULFONE DYE AND A RESIST AGENT

BACKGROUND OF THE INVENTION

1. Field of the Invention

This invention is directed to the field of multi-colored dyeing of polyamides and in particular polyamide carpets.

2. Background of the Invention

Numerous mechanical means are available for the printing of multi-colored patterns on textiles. Additionally, various displacement and resist techniques have been attempted to produce multi-colored dyeings of polyamides such as wool and nylon; particularly multi-colored dyeings of polyamide carpeting.

The best known and most widely used resist/displacement system for producing multi-colored patterns on polyamide carpeting was developed by the Sandoz Company of Basel, Switzerland. This Sandoz system was developed in the late 1970 to early 1980 period and was known as "Lanasyn ®S/Thiotan ®TR System". In practicing this system by the resist method, a standard acid dye and cationic chemical (a tallow diamine—ethylene oxide—quat) known as Thiotan ®TR were placed on the substrate in a desired pattern. Then at the last application point in the textile dyeing line, monosulfonated, 2:1 premetallized acid-type dyes called "Lanasyn ®S dyes" were flooded on to the substrate. The cationic chemical complexed with the monosulfonated, 2:1 premetallized acid dye and prevented its fixation in the printed area. The substrate was then steamed to fix the dyes and produce a multi-colored pattern. In the displacement method, the Lanasyn ®S type dye was applied to the entire surface of the substrate. Next one or more displacement prints were made over the substrate with a mixture of a monosulfonated acid dye and the cationic chemical. Again the cationic chemical complexed with the Lanasyn ®S type dye which prevented its fixation. Steaming fixed the uncomplexed dyes producing an acceptable multi-colored pattern.

This prior art system, although commercially acceptable, had several drawbacks. It was not possible to prevent complete fixation of the Lanasyn ® type dye in the area treated with the cationic chemical. Secondly, although the cationic chemical did selectively complex with the premetallized dye, it also complexed with the standard acid dye. In pale shades up to half the standard acid dyes could be lost. Third, the cationic compound of this system also complexes with anionic stainblockers used in the after-treatment of polyamide carpets to render them stain resistant to acid dyes found in foods and drinks. The complexing of the anionic stainblocker with the cationic chemical renders the stainblocker ineffective. The present invention overcomes all of these disadvantages.

SUMMARY OF THE INVENTION

This invention is directed to a method of producing multi-colored patterns on polyamide substrates. The invention is particularly suited for producing such multi-colored patterns on polyamide carpets by continuous dyeing processes.

The invention is based upon the discovery that fiber-reactive dyes of the vinyl sulfone type can be displaced and prevented from fixing on a polyamide substrate by applying an anionic, water-soluble, fiber-substantative resist chemical to the polyamide to displace and/or prevent fixation of the vinyl sulfone type dye in the resist coated area. This discovery coupled with the fact that acid-type dyes (hereinafter defined) can be fixed in the area treated with the resist allows one to produce multi-colored patterns in fine detail with distinct color patterns e.g., a black and white dyeing with no gray or gray shading between the white and black segments of the pattern.

The vinyl sulfone fiber reactive dyes useful in the invention are well known in the textile dyeing art. They may be represented by the general formula $(SO_3M)_m$-D-$(SO_2$-$Z)_n$ wherein "D" represents a dye chromophore, "M" represents a hydrogen and a water soluble metal atom, "Z" represents a fiber reactive moiety and "m" and "n" represent integers of 1–3 and 1–2, respectively.

Acid-type dyes are also well known in the art and as used in this description includes the "Acid" and "Direct" dyes of the Color Index classification. The resist chemical particularly useful in the invention are exemplified by sulfonated condensation product of phenols and naphthols with an aldehyde.

Intricate colored patterns can be achieved by printing the polyamide substrate with one or more patterns of a printing paste containing the anionic resist chemical and acid-type dye and flooding the substrate with a solution of the reactive dye.

Alternatively, the polyamide substrate can be flooded or blotch printed with the fiber reactive dye and then over-printed in the desired pattern with one or more anionic resist/acid-type dye mixtures. In either case the fiber reactive dye will not fix in the areas treated with the resist. The dyed substrate is then steamed to fix the dyes, washed and dried to produce an intricate clearly defined multi-color dyeing of the polyamide substrate.

Additional advantages of the process of this invention are excellent dye penetration into the polyamide substrate by the vinyl sulfone dye and improved wet fastness. Trap lines of off-shade color at the boundary of acid-type dyed areas and the vinyl sulfone dyed areas are eliminated. Further, since the vinyl sulfone dye can optionally be applied by a flooding or padding technique, there is no need to use a print screen to apply the vinyl sulfone dye. These and other advantages will be apparent to the skilled worker in the art.

DESCRIPTION OF THE PREFERRED EMBODIMENTS

This invention is a process for dyeing polyamides in a multi-colored pattern. Polyamides useful in the practice of the invention include both the natural and synthetic fiber-forming polyamides. Examples of such polyamides are wool, silk, nylon-6, nylon-6,6, nylon-11, nylon-12, nylon-6/6,6, nylon-6,12 etc. Particularly preferred polyamides are wool, nylon-6, nylon-6,6 and nylon 6/6,6 copolymers and blends of such synthetic polyamides. The invention is particularly useful in multi-colored dyeing of nylon-6 and nylon-6,6 carpeting.

The process of the invention includes the following steps:

(a) applying to a polyamide substrate in a predetermined pattern, an anionic, water-soluble, fiber-substantive, resist and an acid-type dye;

(b) applying a water-soluble, fiber-reactive, vinyl sulfone type dye to the entire surface of the substrate and (c) fixing the dyes preferably by thermosoling or steaming; most preferably by steaming. The order of application of the resist/acid-type dye mixture and the vinyl sulfone dye being optional.

Normally the resist will be applied in combination with an acid-type dye or a mixture of two or more acid-type dyes. However, the resist alone may be applied to the substrate to produce an undyed area that is clear or white or the acid-type dye and the resist may be applied sequentially.

The invention provides a method for producing intricate and clearly defined multi-colored patterns on polyamide substrates. It is believed, without being bound to a particular theory, that the vinyl sulfone dye acts like an acid-type dye with a slow strike rate relative to the strike rate of the acid-type dye component and that the anionic resist displaces the vinyl sulfone dye from the resist treated areas of the substrate and/or prevents fixation of the vinyl sulfone dye in the resist treated area. However, the resist does not prevent the acid-type dye component from fixing nor does the resist displace acid-type dye from the resist treated area. Although this description uses the term "displaces", it is readily apparent that if the resist chemical is present, it will prevent the migration of the vinyl sulfone dye into the resist treated area. Whatever mechanism is involved, the invention provides intricate, multi-colored pattern affect, with essentially no mixing of the colors at the boundaries of the different dyes. Additionally the anionic resist does not complex with the acid-type or vinyl sulfone dye and it does not interfere with stainblocker after-treatment of the polyamide substrate.

The anionic, water-soluble, fiber-substantive resist chemicals useful in the invention include sulfonated phenol-aldehyde condensation products, a sulfonated naphthol condensation product, polymethacrylic acid polymers, acrylic acid polymers, copolymers of acrylic acid or methacrylic acid with ethylenically unsaturated comonomers, the polymerization reaction product of an alphasubstituted acrylic acid or ester prepared in the presence of one of the above described sulfonation condensation products, the water soluble salts of said condensation products and said polymerization products and mixtures thereof. These anionic, water-soluble, fiber substantive resist chemical useful in the invention contain —$SO_3X$ and —COOX substituents wherein X is hydrogen or a cation of the alkali earth metals e.g. sodium, potassium, lithium or ammonia. The resist chemical useful in this invention are characterized in that they may be applied in combination with an acid or direct dye and the acid or direct dye may be fixed to the fiber in the resist treated area.

The following U.S. Patents describe the preparation of anionic resist compounds useful in the practice of this invention: U.S. Pat. No. 3,293,214; U.S. Pat. No. 3,663,157, U.S. Pat. No. 3,790,344; U.S. Pat. No. 4,592,940; U.S. Pat. No. 4,619,853; U.S. Pat. No. 4,680,212; U.S. Pat. No. 4,839,212; U.S. Pat. No. 4,879,180; U.S. Pat. No. 4,822,373; U.S. Pat. No. 4,937,123 and U.S. Pat. No. 4,940,757; the teaching of which are hereby incorporated by reference.

Illustrative anionic resist compounds and their preparation are described for example in U.S. Pat. No. 4,592,940 (col 3 & 4) which is incorporated herein by reference. This patent discloses mixed condensation compounds prepared from formaldehyde and a mixture of diphenolsulfone, diphenolsulfone sulfonic acid, phenolsulfonic acid and salts thereof wherein at least 40 percent of the monomeric units contain a sulfonic acid (or salt) radical (—$SO_3X$) and at least 40 percent of the units contain the —$SO_2$— radical. In the formula $SO_3X$, X is hydrogen or a cation. Other useful anionic resists are mixed condensation products of naphthalene monosulfonic acid with diphenylsulfone and formaldehyde.

The preparation of anionic resist chemical from methacrylic acid and copolymers thereof is described in U.S. Pat. No. 4,937,123, Column 3 and 4 thereof and the Examples of said patent, the teaching thereof are incorporated herein by reference.

The preparation of anionic resist chemical prepared by polymerizing an alpha substituted acrylic acid or ester in the presence of a sulfonated aromatic—aldehyde condensation polymer is described in U.S. Pat. No. 4,940,757 at Column 3–6 thereof and the Examples of said patent; the teachings thereof are hereby incorporated by reference.

Illustrative commercially available anionic resist are Erional® PA and Erional®NW from Ciba Geigy; Intratex®N from Crompton and Knowles, Stainfree® from Sybron and Karafix®NA from Lyndal. These resists are sulfonated condensation products of aldehydes and phenols or naphthols and they are the preferred type of anionic resist chemical for the practice of the invention. Another anionic resist commercially available resist is 3M Company's stainblocker FX 661, a mixed sulfonated condensation product of a phenol and aldehyde with a methacrylic polymer. Leukotan® 970, 1027, 1028 and QR 1083 from Rohm and HAAS Co. are examples of commercially available methacrylic polymer anionic resist chemicals. These chemicals are used presently in the textile dyeing industry as stainblockers, leveling agents and wet fastness additives.

The fiber-reactive, vinyl sulfone type dyes useful in the practice of the invention are well known. The main use of such fiber-reactive, vinyl sulfone type dyes has been in the dyeing of cotton. However, U.S. Pat. Nos. 3,802,837 and 4,762,524 teach their use in the dyeing of polyamides. These prior art references teach to use the vinyl sulfone dye as a reaction product with a substituted, secondary, aliphatic amine such as n-methyltaurine.

The following patents illustrate that the vinyl sulfone type dyes are well known:

U.S. Pat. No. 4,336,190 (formazon);
U.S. Pat. No. 4,492,654 (disazo);
U.S. Pat. No. 4,046,754 (monoazo);
U.S. Pat. No. 4,577,015 (dioxazine);
U.S. Pat. Nos. 3,359,286; 4,049,656 (anthraquinone);
U.S. Pat. No. 3,268,548 (phthalocyanine) and;
U.S. Pat. No. 3,385,843 (pyrazolone).

The teachings of the above cited patents are hereby incorporated by reference.

Suitable dyes of the vinyl sulfone type are represented by the following general formula:

$$(SO_3M)_m—D—(SO_2—Z)_n$$

In the above formula, "D" represents a dye chromophore selected from the anthraquinone, dioxazine, formazon, phthalocyanine, mono- and disazo series and their metal complexes wherein the metal is selected from copper, chromium, iron, cobalt and nickel; preferably copper or nickel. Particularly preferred are those chromophores of the formazon series, the mono- and disazo series and their metal complexes. "Z" represents the fiber reactive groups: $—CH=CH_2$ and $—CH_2—CH_2—Y$ wherein "Y" is a substituent capable of being split off by an alkaline reagent: e.g., chlorine, bromine, thiosulfate, sulfato, phosphato, a carboxylic acyloxy of one to four carbon; or by an acidic reagent: e.g., dimethylamino, diethylamino, N-alkyl($C_1$ to $C_4$)-aminoalkyl ($C_1$ to $C_4$) sulfonic or carboxylic ($C_1$ to $C_4$) acids. The sulfato group is preferred. the term "n" represents an integer from 1 to 3; preferably 1 to 2. The term "m" represents an integer from 1 to 4, preferably 1 to 3 and most preferably 1 to 2. The term "M" represents hydrogen and the water soluble metals; e.g. sodium, potassium, lithium or calcium; preferably sodium. The dye chromophore may contain additional fiber reactive groups: e.g. a mono-or di-halogen-s-triazine, a mono cyanamido-s-triazine, a mono-, di- or tri- halogen pyrimidine, a mono or dichloroquinoxaline, a dichlorophthalazine, a dichloropyridazone or the bromine or fluorine derivatives thereof. Of course, the vinyl sulfone dyes may be employed in their water soluble salt form e.g. as sodium, potassium and lithium salts.

Only selected vinyl sulfone dyes are useful in the practice of the invention. It is believed, without being bound to any particular theory, that it is necessary to balance the strike rate of the vinyl sulfone dye against the strike rate of the acid-type dye. In the art, a dye's initial diffusion and reactivity or affinity properties with respect to the fiber are characterized as its strike rate. The term as used in this description is intended to characterize the initial dyeing rate or uptake of the dye during the initial stage of the dyeing process. The vinyl sulfone dye should have a slower strike rate than the acid-type dye. This difference in strike rate enables the anionic resist to force the vinyl sulfone dye to migrate from the resist-treated area of the substrate before it can fix to the fiber.

Vinyl sulfone type dyes with two sulfonic acid ($—SO_3M$) substituents where "M" is hydrogen or a water soluble metal (sodium, lithium, potassium etc.) and one vinyl sulfone group ($—SO_2—Z$) work fairly well depending upon the dye's cold strike rate. Vinyl sulfone dyes with two to three sulfonic acid groups and two vinyl sulfone groups or one vinyl sulfone group and one monohalide triazine group are preferred because of their slow cold strike rate. In general, vinyl sulfone dyes with only one sulfonic acid group and one vinyl sulfone group have strike rates which are too fast and they can stain a resist-treated polyamide substrate. Preferably, the sum of the integers m and n in the formula $(SO_3M-)_m—D—(SO_2—Z)_n$ will be three or more. However, a vinyl sulfone dye in which m and n is both one, may be used in the practice of the invention provided the dye chromophore contains an additional fiber reactive group of the triazine, pyrimide, haloquinoxaline, or halophthalazine type listed above; most preferred are the monochlorotriazine substituents.

In the displacement method of applying the resist/acid-type dye mixture (i.e. the vinyl sulfone dye is applied to the substrate first), the selection of the vinyl sulfone dye or dyes is more critical because the strike rate of the vinyl sulfone dye must be slow enough for the resist to force the vinyl sulfone dye off the fiber area that has been treated with the resist. In the resist method of applying the dyes, (i.e. the resist/acid-type dye applied first), the selection of the vinyl sulfone dye or dyes is not as critical but the same vinyl-sulfone dyes are preferred.

The selection of the vinyl sulfone dye or dyes may be determined by simple experimentation. The addition of agents such as ethoxylated aliphatic amines; e.g. the ethoxylate of tallow amine with 15 moles of ethylene oxide may be added to the dye to slow the strike rate of a dye.

The control of pH is also important in the practice of the invention. Generally, the pH of the dyeing process is controlled in the pH range of about 2 to about 7. The pH value of the vinyl sulfone dye mixture should not be lower than about 3 if the vinyl sulfone dye is applied first (displacement method). Higher pH's slow down the strike rate of the vinyl sulfone dye and conversely lower pH's increase its strike rate.

In the displacement application method, the vinyl sulfone dye can be mixed with an acid generator such as ethoxylated formic acid. The pH adjusted to about 6–7 and applied to the substrate. The resist and acid-type dye are then applied at a pH of about 6 to 7 also. When the dyed fabric is steamed to fix the dyes, the acid generator will decompose, liberate acid and drop the pH. Thus, the vinyl sulfone dye has more time to migrate from the resist treated area because it has a slow strike rate at the high pH.

A different pH control procedure is practiced when the resist/acid-type dye mixture is applied to the substrate first. The resist/acid-type dye mixture is applied at pH of about 6 to 7. The vinyl sulfone is then applied at a pH of about 1.5 to 4, preferably about 3 to 4 in order to have the vinyl sulfone strike fast and not interfere or mix with the resist/acid-type dye pattern. However, if the dyeing is to be done at a high wet pick up ratio (>500%) the resist—acid-type dye application should be done at a pH of about 2 to 3 to fix the acid-type dye rapidly and the pH of the vinyl sulfone also should be kept low; i.e. about 1.5 to 3.0 so that the vinyl sulfone dye fixes rapidly. The skilled artisan can adjust the pH within these parameters by simple experiments to arrive at optimum conditions.

The acid-type dyes which can be used in this invention are those dyes containing one or more anionic functional groups. The acid-type dyes useful in the practice of the invention are classified in the "Color Index" under the classifications "Acid" and "Direct". "Mordant" dyes and "Reactive" dyes under the "Color Index" classification are not within the scope of the term "acid-type" dyes as used in this disclosure, nor are those dyes having fiber reactive substituents. Acid dyes have large molecules containing one or more functional sulfonic or carboxylic acid salt groups. Direct dyes are a special class of dyes which have a long, narrow, flat molecule and one or more carboxylic or sulfonic acid salt functional groups which allow these dyes to function in the same manner as an "Acid" dyes. The "acid-type" dyes useful in the invention are termed "anionic dyes" in U.S. Pat. No. 4,218,217 and described at Column 4, lines 29–59 thereof; the disclosure thereof is hereby incorporated by reference.

The preferred acid-type dyes useful in the invention are the monosulfated acid dyes and 2:1 metal complexed acid dyes (2 moles of acid dye to 1 mole of metal).

The invention may be used to produce hard-line pattern printing and accent printing. Hard-line prints are characterized by repeatable patterns with distinct recognizable boundaries between colors. Accent printing is characterized by a continuous background color over which accenting colors are applied as specks, dots, streaks etc., in a somewhat random pattern.

Conventional methods of applying dyes to a substrate can be used in producing multi-colored dyeing according to the invention. These methods of application include padding, printing, spraying, dropping etc. The background color can be applied to the substrate and discontinuous color(s) or pattern(s) applied over it or the reverse procedure may be employed. Illustrative machines or apparatus known in the art for application of dyes and useful in the practice of the invention are rotary screen printers, TAK® machines, jet printers, pad rolls, spray nozzles etc. The application methods vary widely in continuous dyeing depending upon the type and placement of application equipment on the line and are obvious to the skilled artisan.

Illustrative application methods are as follows:

A. (1) Print with acid-type dye(s) and resist chemical; and
(2) Flood with vinyl sulfone dye.
B. (1) Print with acid-type dye(s) and resist chemical;
(2) Apply acid-type dye(s) and resist with TAK® machine; and
(3) Flood with vinyl sulfone dye(s)
C. (1) Apply gum layer containing a resist chemical.
(2) Apply acid-type dye(s) and resist chemical through 4 Colorflo heads;
(3) with vinyl sulfone dye(s) solution on Colorflo plane.
D. (1) Apply acid-type dye(s) and resist chemical through 1 to 4 Colorflo heads; with
(2) vinyl sulfone dye on Colorflo plane.
E. (1) Print substrate with acid-type dye(s) and resist chemical;
(2) Apply gum layer containing a resist chemical; and
(3) Flood with vinyl sulfone dye(s).
F. (1) Apply gum layer containing a resist chemical;
(2) Apply acid-type dye(s) and resist through two Colorflo heads; and
(3) Apply vinyl sulfone dye(s) through two Colorflo heads
G. (1) Print with acid-type dye(s) and resist chemical; and
(2) Apply vinyl sulfone dye(s) through 1 to 4 Colorflo heads.

The resist/acid-type dye mixture may be applied by a printing technique as a paste. The printing pastes used for the application of the resist or the resist/acid-type dye mixture are conventional, containing such additives as thickeners, wetting agents, antifoams, acid, alkali metal salts (TSP), etc. The use of other anionic chemicals such as dioctyl sulfusuccinate and sodium dodecyl diphenyl disulfonate should also be avoided as well as the use of sequestering agents such as ethylene diamine tetraacetic acid and nitrilotriacetic acid. The resist is used at a level of about 4 to 50 g./liter of active product, preferably about 6 to 20 g./liter when a resist of the sulfonated phenol/aldehyde condensation product is used. If a white (undyed) color is desired, with the latter type of resist, about 8.5 g/l to 12 g/l give good effects in the resist method of application and for colored effects about 3 g/l to about 6 g/l, preferably about 5 g/l.

The amount of resist can be varied to obtain the desired effect and by simple experimentation by the skilled artisan. The amount of resist chemical employed can vary from about 0.01 to about 10 percent by weight based upon the weight of the substrate. It is readily apparent that the amount of resist material used will depend on the desired color effect, the dyes used and the method of applications.

The vinyl sulfone dyes used in the following examples are illustrative of the vinyl sulfone dyes that may be used in this invention. The structures of these dyes are shown in Table 1 in their free acid from wherein the dyes are designated Yellow 1, Yellow 2, Red 1, Blue 1 and Black 1 for reference purposes.

The acid-type dyes used in the following examples are acid-type dyes and are referenced by their Color Index (CI) number. Illustrative dyes useful in the invention are Acid Yellow 49, Acid Yellow 151 (2:1 premetallized), Acid Blue 277, Acid Orange 156, Acid Red 266, Acid Red 337, Acid Blue 324, Acid Blue 158 (a pre-metallized acid dye) Acid Blue 78, and Direct Red 185.

The dyes after application to the substrate are fixed to it. The fixing process if preferably conducted using heat and most preferably by steaming. A steaming time of about 5 to about 10 minutes, preferably about 8 minutes. After the fixing step, the substrate is washed to removed unfixed dye. Washing may be done with cold water or optionally hot water (120° F.) using conventional washing equipment found on continuous dyeing lines. An anionic or cationic soaping agent may be added to the wash water. After washing the substrate is dried in the usual manner.

EXAMPLES 1-7

These examples illustrate the resist method of application. In all cases the dyeing were conducted in a continuous manner on a polyamide nylon 6—6, carpet substrate. The following abbreviations are used in the examples:

(a) pad wet out—means that the material was applied by the padding method to the entire surface of the substrate.

(b) print—means the application method was by a rotary printer of the Mitter type.

(c) TAK—means the application method was by a TAK® machine in the known manner.

(d) Kuster Flood—means application method was by a Kuster machine in the known manner.

(e) The term Colorflo head and Colorflo plane mean those apparatus found in a Colorflo dye applicator used in the manner disclosed.

TABLE I

| VINYL SULFONE DYES |
|---|
| YELLOW 1 |

TABLE I-continued
VINYL SULFONE DYES
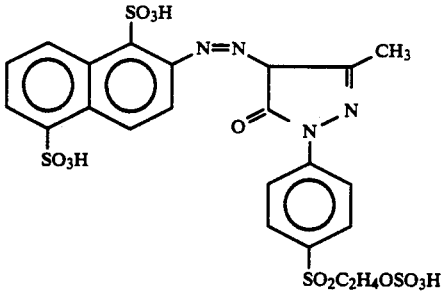
YELLOW 2
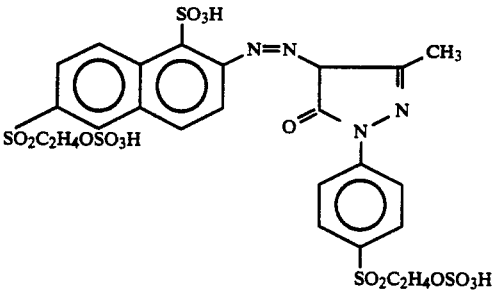
RED 1
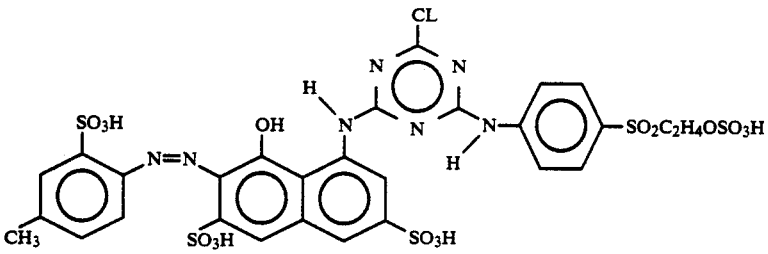
BLUE 1
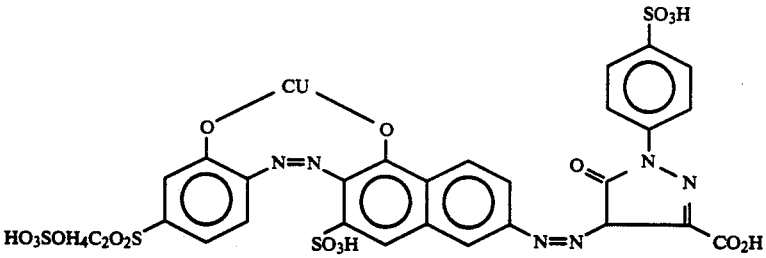
BLACK 1
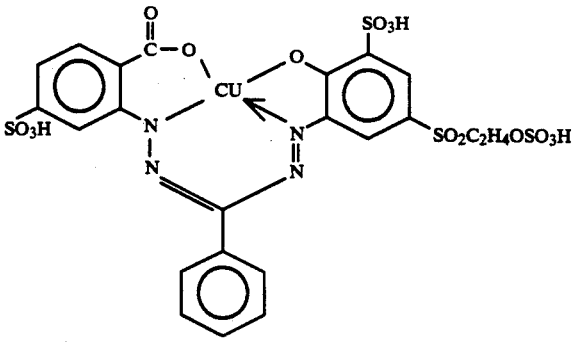

EXAMPLE 1

| | |
|---|---|
| | Pad wet out: |
| 1.0 g/l | Hostapur ® CX wetter, nonionic |
| | TAK 1: |
| .40 g/l | Acid Red CI 361 Dye |
| 1.50 g/l | guar thickener |
| 100.00 g/l | Erionyl ® NW (Ciba-Geigy) resist |
| pH 2.5 | viscosity 20 cps (pH adjusted with acid buffer) |
| | TAK 2: |
| .40 g/l | Acid Blue CI 227 Dye |
| 1.50 g/l | guar thickener |
| 100.00 g/l | Erionyl ® NW resist |
| pH 2.5 | viscosity 20 cps |
| | Kuster Flood: |
| 3.50 g/l | Vinyl Sulfone Black 1 Dye |
| 1.56 g/l | guar thickener |
| 2.00 g/l | Hostapur ® CX (tridecyl alcohol) |
| pH 3.0 | viscosity 25 cps |

The result was a carpet with pure pink and blue tips with a dark black base. No staining of the tip colors by the vinyl sulfone dye was noticeable.

EXAMPLE 2

| | |
|---|---|
| Pad wet out: same as previous Example 1 | |
| | Print 1: |
| 100.00 g/l | Erionyl ® NW resist |
| 14.00 g/l | guar thickener |
| pH 2.5 | viscosity 3000 cps |
| | Print 2: |
| 2.00 g/l | Acid Orange CI 156 Dye |
| 100.00 g/l | Erionyl ® NW resist |
| 14.00 g/l | guar thickener |
| pH 2.5 | viscosity 3000 |
| | TAK 1: |
| 2.00 g/l | Acid Red CI 361 Dye |
| 1.50 g/l | guar thickener |
| 100.00 g/l | Erionyl ® NW resist |
| pH 2.5 | viscosity 20 cps |
| | TAK 2: |
| 2.00 g/l | Acid Blue CI 277 Dye |
| 1.50 g/l | guar thickener |
| 100.00 g/l | Erionyl ® NW resist |
| pH 2.5 | viscosity 20 cps |
| | Kuster flood: |
| 4.00 g/l | Vinyl Sulfone Yellow 1 Dye |
| 1.50 g/l | Vinyl Sulfone Red 1 Dye |
| 1.50 g/l | Vinyl Sulfone Blue 1 Dye |
| 2.00 g/l | Hostapur ® CX |
| pH 2.5 | viscosity 20 cps |

The result was a carpet with white, yellow, red, and blue dots on the surface with a dark brown base.

EXAMPLE 3

| | |
|---|---|
| | Print 1: |
| .50 g/l | Acid Yellow CI 49 Dye |
| pH 3.0 | viscosity 3000 cps |
| | Print 2: |
| .50 g/l | Acid Yellow CI 49 Dye |
| pH 7.0 | viscosity 3000 cps |
| | Kuster flood: |
| 4.00 g/l | Vinyl Sulfone Blue 1 Dye |
| pH 3.0 | viscosity 20 cps |

The result was that in print #1 the resist effects were poor and the shade was a green instead of bright yellow. Print #2 was better but it was a yellow green.

EXAMPLE 4

| | |
|---|---|
| | Print 1: |
| .50 g/l | Acid Yellow CI 49 Dye |
| 10.00 g/l | Sybron Stainfree ® (resist) |
| pH 3.0 | viscosity 3000 cps |
| | Print 2: |
| .50 g/l | Acid Yellow CI 49 Dye |
| 10.00 g/l | Sybron Stainfree ® (resist) |
| pH 7.0 | viscosity 3000 cps |
| | Kuster flood: |
| 4.00 g/l | Vinyl Sulfone Blue 1 Dye |
| pH 3.0 | viscosity 20 cps |

The results were that print 1 had a fair resist with only a slight green shade and print 2 had a good resist with only a very slight green shade.

EXAMPLE 5

| | |
|---|---|
| | Print 1: |
| .50 g/l | Acid Yellow CI 49 Dye |
| 25.00 g/l | Sybron Stainfree ® resist |
| pH 3.0 | viscosity 3000 cps |
| | Print 2: |
| .50 g/l | Acid Yellow CI 49 Dye |
| 25.00 g/l | Sybron Stainfree ® resist |
| pH 7.0 | viscosity 3000 cps |
| | Kuster flood: |
| 4.00 g/l | Vinyl Sulfone Blue 1 Dye |
| pH 3.0 | viscosity 20 cps |

The result was that on both prints there was a total resist and the shades were bright lemon yellow.

EXAMPLE 6

| | |
|---|---|
| | Pad wet: |
| 1.0 g/l | Hostapur ® CX |
| | Print: |
| 1.0 g/l | Acid Blue CI 324 Dye |
| 14.0 g/l | thickener |
| 15.0 g/l | Grifftex ® CB 130 resist |
| pH 3.0 | viscosity 3000 cps |
| | Gum layer: |
| 25.0 g/l | Grifftex ® CB 130 resist |
| 10.0 g/l | thickener |
| pH 3.0 | viscosity 2000 cps |
| | Kuster flood: |
| 1.0 g/l | Vinyl Sulfone Yellow 1 Dye |
| 3.5 g/l | Vinyl Sulfone Blue 1 Dye |
| pH 2.5 | viscosity 20 cps |

The result was a carpet with a bright blue print on the tips surrounded by white areas from the gum layer. The base was a dark teal shade.

EXAMPLE 7

| | | |
|---|---|---|
| | Pad wet out: same as previous Example 6. | |
| | | Gum layer: |
| | 25.0 g/l | Grifftex ® CB 130 resist |
| | 10.0 g/l | thickener |
| | pH 2.5 | viscosity 2000 |
| | | Colorflo: (water down the plane) |
| Head 1 | 1.5 g/l | Acid Yellow CI 151 Dye |
| | 1.5 g/l | thickener |
| Head 2 | 1.5 g/l | Acid Yellow CI 49 Dye |
| | 1.0 g/l | Acid Blue CI 277 Dye |
| | 1.5 g/l | thickener |
| | pH 2.5 | viscosity 20 cps |

-continued

| | |
|---|---|
| Head 3 | 2.0 g/l Vinyl Sulfone Red 1 Dye |
| | 1.5 g/l thickener |
| | pH 2.0 viscosity 20 cps |
| Head 4 | 2.0 g/l Vinyl Sulfone Blue 1 Dye |
| | 1.5 g/l thickener |
| | pH 2.0 viscosity 20 cps |

The result was a carpet with white tip areas from the gum layer and green and yellow tip areas from the regular acid dyes. The vinyl sulfone dyes were resisted and thus dyed the base areas in a red and blue shade.

EXAMPLES 8-14

The following examples illustrate the invention using the displacement method of application. In these examples the dyes were applied by printing. The printing paste contained the amount of dye identified for each example and the following amounts of:

nonionic wetting agent—4.7 g/l defoamer—2.7 g/l

Guar thickener and sulfonic acid or trisodium phosphate were used to adjust the paste viscosity and pH to value set forth for the Examples. The polyamide substrate was a nylon 6—6, carpet substrate. The term "blotch" print means the print was made over the entire surface of the substrate. A flat bed printer was used.

EXAMPLE 8

| | |
|---|---|
| Blotch print - | 3.0 g/l Vinyl Sulfone Yellow 2 Dye |
| | 1.0 g/l Vinyl Sulfone Red 1 Dye |
| | 1.0 g/l Vinyl Sulfone Blue 1 Dye |
| | pH 3.0 viscosity 2000 cps |
| Displace print - | .2 g/l Acid Blue CI 324 Dye |
| | 20.0 g/l Karafix ® NA (resist) |
| | pH 6.0 viscosity 5000 cps |

The result was a print with pale blue tips and a brown base.

EXAMPLE 9

| | |
|---|---|
| Blotch print - | 4.0 g/l Vinyl Sulfone Black 1 Dye |
| | pH 3.0 viscosity 1500 cps |
| Displace print - | 50.0 g/l Karafix ® NA (resist) |
| | pH 7.0 viscosity 5000 cps |

The result was a print with white tips and a black base.

EXAMPLE 10

| | |
|---|---|
| Blotch print - | 4.0 g/l Vinyl Sulfone Yellow 1 Dye |
| | 1.3 g/l Vinyl Sulfone Red 1 Dye |
| | 1.0 g/l Vinyl Sulfone Blue 1 Dye |
| | 2.0 g/l Acid generator |
| | pH 7.0 with ammonia viscosity 1500 cps |
| Resist Print - | 0.2 g/l Acid Yellow CI 49 |
| | 25.0 g/l Karafix ® NA resist |
| | pH 7.0 viscosity 7000 cps |

The result was a print with bright yellow tips and a brown base.

EXAMPLE 11

| | |
|---|---|
| Blotch print - | .70 g/l Vinyl Sulfone Yellow 1 Dye |
| | 3.2 g/l Vinyl Sulfone Blue 1 Dye |

-continued

| | |
|---|---|
| | pH 3.0 viscosity 1800 cps |
| Displace print - | .016 g/l Acid Yellow CI 49 Dye |
| | .30 g/l Acid Red CI 337 Dye |
| | .017 g/l Acid Blue CI 324 Dye |
| | 20.0 g/l Resist |
| | pH 6.0 viscosity 5000 cps |

The result was a print with rose and grey tips and a teal green base.

EXAMPLE 12

| | |
|---|---|
| Resist print - | .20 g/l Acid Yellow CI 49 Dye |
| | 25.0 g/l Sybron Stainfree ® (resist) |
| | pH 3.0 viscosity 9000 cps |
| Resist print - | .20 g/l Acid Yellow CI 49 Dye |
| | 25.0 g/l Resist |
| | pH 7.0 viscosity 9000 cps |
| Blotch print - | 3.0 g/l Vinyl Sulfone Black 1 Dye |
| | pH 3.0 viscosity 1200 |

The result was that the resist print with the 7.0 pH showed better resist effects than the pH 3.0 print. In both cases a yellow print was obtained was over a charcoal grey.

EXAMPLE 13

| | |
|---|---|
| Resist print - | .20 g/l Acid Yellow CI 49 Dye |
| | 25.0 g/l Sybron Stainfree ® (resist) |
| | pH 7.0 viscosity 9000 cps |
| Resist print - | .25 g/l Acid Yellow CI 49 Dye |
| | .25 g/l Acid Blue CI 324 Dye |
| | 25.0 g/l Sybron Stainfree ® resist |
| | pH 7.0 viscosity 9000 cps |
| Blotch print - | 3.0 g/l Vinyl Sulfone Black 1 Dye |
| | pH 3.0 viscosity 12000 |

The result was a yellow and green pattern on the tips with a charcoal grey base.

EXAMPLE 14

Resist print 1 & 2 were the same as in Example 13

| | |
|---|---|
| Resist print 1 & 2 were the same as in Example 13. | |
| Blotch print - | 3.0 g/l Vinyl Sulfone Yellow 1 Dye |
| | 1.0 g/l Vinyl Sulfone Red 1 Dye |
| | 1.0 g/l Vinyl Sulfone Blue 1 Dye |
| | pH 3.0 viscosity 1200 cps |

The result was a carpet with a green and yellow pattern on the tips with a brown base underneath.

I claim:

1. A method of dyeing a polyamide substrate in a multi-colored pattern which comprises:

(1) applying to said substrate:

a) an anionic, water-soluble, fiber-substantive resist compound selected from sulfonated phenolaldehyde condensation products, sulfonated naphthol condensation products, polymethacrylic acid polymers, acrylic acid polymers, copolymers of acrylic acid and methacrylic acid with ethylenically unsaturated co-monomers, the polymerization reaction product of an alpha-substituted acrylic acid or ester prepared in the presence of one or more of said sulfonated condensation products, the water soluble salts of said condensation products and said polymerization products and mixtures thereof;

b) one or more fiber reactive vinyl sulfone dyes; wherein the order of application said resist and said vinyl sulfone dye is optional; and wherein said resist is applied in a predetermined pattern to said substrate;

(2) wherein said dyeing is conducted at a pH of from about 2 to about 7; and (3) fixing dye or dyes to said substrate 2. The method of claim 1 wherein said resist is applied in one or more predetermined patterns over a portion of said substrate.

3. The method of claim 1 wherein said polyamide substrate is selected from nylon 6—6, nylon 6 and mixtures thereof.

4. The method of claim 1 wherein said resist compound is selected from sulfonated condensation products of a phenol and an aldehyde, sulfonated condensation products of a naphthol and an aldehyde, the water soluble salts thereof and mixtures thereof.

5. The method of claim 2 wherein one or more acid-type dyes selected form the acid and direct dyes are applied to said substrate on the resist treated portion of said substrate.

6. The method of claim 5 wherein said acid dye is selected from a monosulfonated acid dye, a 2:1 premetallized acid dye and mixtures thereof.

7. The method of claim 6 wherein said resist chemical is selected from the sulfonated condensation products of a phenol and an aldehyde, sulfonated condensation products of a naphthol and an aldehyde, the water soluble salts thereof and mixture thereof.

8. The method according to claim 7 wherein said vinyl sulfone dye contains one or more sulfonic acid substituents and one or more vinyl sulfone substituents with the provision that the number of vinyl sulfone and sulfonic acid substituents is three or more.

9. The method according to claim 7 wherein said vinyl sulfone dye contains one or more sulfonic acid substituents, one or more vinyl sulfone substituents and a second fiber reactive substituents selected from mono- or di-halogen-s-triazine, mono cyanamido-s-triazine, mono-, di- or tri- halogen pyrimidine, mono or dichloroquinoxaline, dichlorophthalazine, dichloropyridazone or the bromine or fluorine derivatives thereof wherein the number of vinyl sulfone, sulfonic acid and said second fiber reactive substituents is three or more.

10. A polyamide carpet dyed in a multi colored pattern in accordance with the process of claim 1.

11. A polyamide carpet dyed in a multi colored pattern in accordance with the process of claim 2.

12. A polyamide carpet dyed in a multi colored pattern in accordance with the process of claim 3.

13. A polyamide carpet dyed in a multi colored pattern in accordance with the process of claim 4.

14. A polyamide carpet dyed in a multi colored pattern in accordance with the process of claim 5.

15. A polyamide carpet dyed in a multi colored pattern in accordance with the process of claim 6.

16. A polyamide carpet dyed in a multi colored pattern in accordance with the process of claim 7.

17. A polyamide carpet dyed in a multi colored pattern in accordance with the process of claim 8.

18. A polyamide carpet dyed in a multi colored pattern in accordance with the process of claim 9.

* * * * *